US006679812B2

(12) United States Patent
Torkelson

(10) Patent No.: US 6,679,812 B2
(45) Date of Patent: Jan. 20, 2004

(54) MOMENTUM-FREE RUNNING EXERCISE MACHINE FOR BOTH AGONIST AND ANTAGONIST MUSCLE GROUPS USING CONTROLLABLY VARIABLE BI-DIRECTIONAL RESISTANCE

(75) Inventor: Torkel E. Torkelson, Naples, FL (US)

(73) Assignee: Vert Inc., Naples, FL (US)

( * ) Notice: Subject to any disclaimer, the term of this patent is extended or adjusted under 35 U.S.C. 154(b) by 0 days.

(21) Appl. No.: 09/731,505

(22) Filed: Dec. 7, 2000

(65) Prior Publication Data

US 2002/0072452 A1 Jun. 13, 2002

(51) Int. Cl.[7] ..... A63B 21/06
(52) U.S. Cl. ..... 482/51; 482/57; 482/901
(58) Field of Search ..... 482/1–9, 51, 67, 482/57, 52, 53, 90, 97, 100, 137, 134, 138, 142, 901

(56) References Cited

U.S. PATENT DOCUMENTS

| | | | | |
|---|---|---|---|---|
| 3,953,025 A | | 4/1976 | Mazman | |
| 4,354,676 A | | 10/1982 | Ariel | |
| 4,544,154 A | | 10/1985 | Ariel | |
| 4,726,583 A | | 2/1988 | Olsen et al. | |
| 5,785,631 A | * | 7/1998 | Heidecke | 482/5 |
| 5,941,804 A | | 8/1999 | Johnston et al. | |

* cited by examiner

*Primary Examiner*—Glenn E. Richman
(74) *Attorney, Agent, or Firm*—Cooper & Dunham LLP

(57) ABSTRACT

A computer controlled exercise machine, particularly adapted for running exercises, virtually eliminates inertial effects and controls resistance to pushing and pulling as a function of instantaneous position in a stroke and/or instantaneous velocity, using the controlled flow of working fluid through computer-controlled valves and sensors of various system parameters in a feedback loop.

10 Claims, 3 Drawing Sheets

MOMENTUM-FREE RUNNING EXERCISE MACHINE FOR BOTH AGONIST AND ANTAGONIST MUSCLE GROUPS USING CONTROLLABLY VARIABLE BI-DIRECTIONAL RESISTANCE

FIELD

This patent specification is in the field of exercise machines and methods. It relates more specifically to equipment and exercises designed to enhance performance in activities such as running, jumping and the like but also has a broader application.

BACKGROUND

Various types of exercise machines are used to enhance athletic performance and promote health and well-being, for medical tests and treatment, for rehabilitation after injury or illness, for elder care, and for other purposes. It is believed that the use of such equipment is growing, both in public facilities such as sports clubs and at home.

Known exercise machines typically focus on particular muscle groups and typically require acting against gravity or spring action. With gravity-based machines, as with free weights, the user moves and accelerates/decelerates a mass against gravity. Because of the forces involved and the nature of the exercises, inertia is a significant limiting factor, resisting or even precluding rapid changes in direction and speed. This in turn typically makes it impractical and even dangerous to do exercises such as those simulating the fast, explosive movements many sports value. Too fast a movement or change in direction with gravity-based machines can generate inertia forces so high that they dramatically increase the opposing forces and can injure the user. As a result, users of gravity-based equipment or free weights are constrained to relatively slow movements, and an adage of many trainers is "up in three, down in four" (counts).

Examples of such gravity-based exercise machines are available from many companies. One is equipment from Nautilus and another is proposed in U.S. Pat. No. 5,941,804 and involves simulating running by using weights 38 mounted on hubs 37 and a gas-charged (or similar) lift support 47. Similar considerations apply to exercise machines that rely on spring action provided by coil or leaf springs or rubber bands or belts instead of weights.

Other types of exercise machines use brake pads or other braking systems to provide resistance to movement. One example is proposed in U.S. Pat. No. 3,953,025, where brake pads press against a disc that the user rotates in arm-training (FIG. 1) or leg-training (FIG. 11). The degree of resistance is said to be adjustable by turning a knob that changes the force with which the pads press against the disc (and thus the braking force). However, this does not appear to provide a practical way to customize resistance to the needs of individual users and exercises, or to vary resistance during a movement, or to control resistance in ways that are repeatable or easily measurable. More controlled resistance to movement can be provided with an electrohydraulic system, as proposed in U.S. Pat. Nos. 4,726,583 and 4,354,676, where the user can push or pull a piston moving in a cylinder containing fluid that exits through a control valve at a desired flow rate. U.S. Pat. No. 4,544,154 proposes an exercise machine using feedback to control the resistance of a hydraulic cylinder. The last three patents are hereby incorporated by reference. Exercise machines that incorporate electrohydraulic cylinders and computer controls to selectively vary the resistance to user movement have been placed in public use at the Private Training Centers, 2300 Santa Monica Boulevard, Santa Monica, Calif., under the trade name VERT.

Various types of machines directed specifically to running exercises also have been proposed. One common type uses a moving belt on which the user runs. The belt can be horizontal or can be inclined at a selected angle to simulate running uphill. Another type is proposed in U.S. Pat. No. 5,941,804, hereby incorporated by reference, involves placing the user's shoulders against a harness and the user's legs in foot assemblies that move against gravity acting on weights. As with other gravity-based machines, inertia is a factor that can make it impractical to simulate the fast, explosive movements common in sports such as football, basketball and in many other activities.

SUMMARY OF THE DISCLOSURE

An object of the system disclosed in this patent specification is to provide exercise equipment useful for improving starting strength, acceleration and overall strength in a safe, convenient and particularly effective manner, and to provide a system that is versatile and can be easily adapted to different users, exercises and goals.

Overall strength can be important in many activities, and starting strength and acceleration can be paramount in others. Starting strength in running can be thought of as the strength needed for the first few of steps of a race or other running activity. Starting ability is related to reaction time and explosive strength or power. Acceleration in this context can be thought of as the ability to rapidly come up to the highest speed attainable under the circumstances. In some sports such as the 100-meter dash, the athlete may come up to a maximum attainable speed over tens of meters, and the body angle may change during that time. In other sports such as football or basketball the players often do not attain their absolute maximum speeds, for example because the spurts of running are too short. The body angle still may change during the rapid acceleration and deceleration, or may change in different ways. For these and other reasons, it can be more important to train for the maximum speed attainable over shorter distances and at different body angles, instead of or in addition to training for an absolute maximum attainable speed.

In one embodiment the system disclosed in this specification provides an exercise system in which a support frame maintains a shoulder harness and foot pedals at adjustable, selected positions relative to each other. This adjustability enables users of different body sizes and planning different exercise regimes to fit comfortably and at the desired body angle when they place their feet at the foot pedals and shoulders against the shoulder harness. The shoulder harness preferably includes a chest support that can be placed at a selected angle and height to match a particular user and particular exercises.

To provide a particularly wide choice of exercise regimes, the foot pedals act on respective bi-directional, variable resistance elements that are under computer control. In this example of an embodiment, the pedals connect to the resistance elements through direction-reversing levers pivoted about an upper portion of the support frame. Under precise and repeatable computer control, the resistance elements offer selected, well controlled degrees of force opposing motion and acceleration, preferably independently in each direction and for each foot pedal and even during a motion stroke. The resistance elements can be fluid-filled cylinders, each having a piston moving therein against fluid pressure that can be changed rapidly under computer control, before or during the exercise or during particular motions, by changing the rate of flow of fluid in or out of the cylinders or portions thereof.

DETAILED DESCRIPTION OF THE PREFERRED EMBODIMENTS

Figure 1:
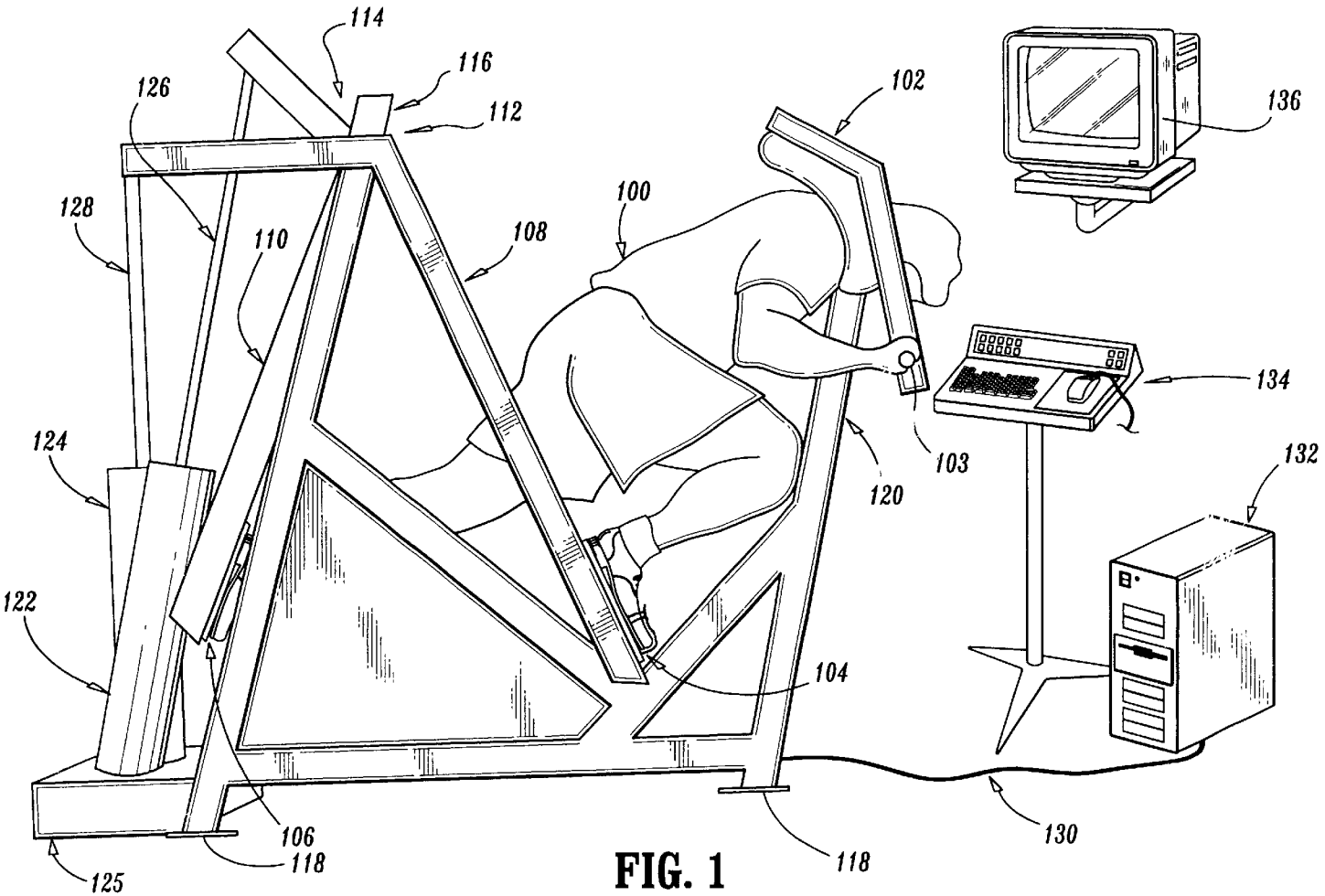
FIG. 1 is a perspective view of an embodiment.

Referring to FIG. 1, a user 100 is in an exercise position with his shoulders against a shoulder harness 102 and feet at foot pedals 104 and 106 supported at lower ends of respective direction reversing levers 108 and 110. An intermediate portion of each lever is pivoted, at 112 and 114, at an upper rear portion 116 of a support frame that rests on pads 118 and is generally rhomboid in side elevation. In top elevation, the support frame can be generally rectangular, and in front and back elevation can comprise a lower rectangular support from which single front and back posts rise. The back posts supports levers 108 and 110 pivotally, and the back post supports a shoulder harness 102 secured to an upper front portion 120 of the front post, preferably slidably so as to move up or down relative to front portion 120. Shoulder harness 102 can include a chest support that can move with the harness up or down, or can move independently of the rest of the harness, and can rotate about an axis transverse to the length of the frame to match different users and exercises. A releasable locking mechanism can secure the chest support at the desired angle. The same or a separate locking mechanism can releasably lock shoulder harness 102 relative to a support element 120, at a height and/or an angle suiting a particular user and type of exercise. Foot pedals 104 and 106 also preferably are secured slidably and lockably to respective levers 108 and 110 so they can be released and moved up or down and then locked in position to suit a particular user and a particular type of exercise. Preferably, foot pedals 104 and 106 have foot clips and/or harnesses that can keep the feet in place, or further harness the feet in place, to enable the user to move one or both levers 108 and 110 by both pushing and pulling, in generally opposite directions. Cushioning is provided at one or both ends of the pivoting motion of levers 108 and 110. For example, rubber pads can be secured to the support frame so the lower end of the levers will come to rest against these rubber pads at the end of a push on a foot pedal.

Bi-directional resistance elements 122 and 124 are secured at their lower portions to a support 125, preferably pivotally to rock back and forth, and enclose respective pistons movable against fluid pressure (and relatively minor resistance and inertia) along the respective resistance elements. Respective shafts 126 and 128 are secured at their lower ends to the pistons in elements 122 and 124 and are secured, preferably pivotally, at their upper ends to back ends of levers 108 and 110, respectively. Resistance elements 122 and 124 can be cylindrically shaped, and each can be provided with at least one valve controlling the flow of fluid in and out of the portions of the cylinder at each side of each piston, to thereby control the resistance to motion and acceleration of the piston. Each valve in turn is operatively connected to a computer control 132, for example through a cable 130, and is subject to computer control over the flow rate the valve allows. The valves are operated by electric motors. The flow rate, and changes in the flow rate, can be set by a user using a panel 134 that can contain input devices such as a computer keyboard, mouse, buttons and the like. Pre-programmed exercise regimes can be used for the purpose, or the user can change the programming or create a customized exercise. A display 136 coupled with computer 132 can be provided to selectively display information settings of the equipment, exercise parameters, etc.

For a typical exercise session, the user selects through panel 134 a particular program for the resistance that elements 122 and 124 will offer, sets the desired position of shoulder harness 120 and/or its chest support by releasing its locking arrangement, moving the shoulder harness and/or chest support up or down and/or to a different angle, and then again locking the relevant component(s) in position. The user sets foot pedals 104 and 106 at desired positions, again by releasing their locking arrangements, moving them up or down on levers 108 and 110 and again locking them in position. In addition, or instead, the foot pedals can be mounted on levers 108 and 110 such that they can be set at different distances from the levers and different orientations relative to the levers. Preferably, the body angle is in the range of 30°–45°, but smaller or greater angles can be provided as well. Of course, the user can omit any or all of these steps if satisfied with the existing settings. Further, the user can select what display 136 will show, for example again through computer panel 134. The user then steps into foot pedals 104 and 106 and secures his or her feet thereto with the foot harnesses to be able to both push and pull the foot pedals, and places the shoulders against shoulder harness 102, preferably grasping hand bars 103. The user then simulates running by alternately pressing and pulling foot pedals 104 and 106, or simulates jumping by pushing both pedals together, or simulates other activity.

Typically, after securing the feet and shoulders in position the user pushes back with both legs until the legs are fully extended and the hips are locked forward. An exercise session can begin by alternating leg presses, and speed can be increased as the user gets the feel of the machine and gains confidence. Emphasis can be placed on full range of motion and achieving full hip extension with each leg movement.

To improve strength and power, the user can press the foot pedals alternately, maintaining full hip extension on each stroke. If the resistance is too much to do that, it can be reduced to allow it because a full hip extension tends to engage the muscle groups particularly important in running, the gluteus muscles and hamstrings while less than a full extension can place excessive load on the quadriceps. The user can do a prescribed number of repetitions for each set, for example in the range of 6–15 repetitions.

To focus on anaerobic capacity, the resistance the machine provides to leg motion can be set relatively low, to provide a relatively light load, but the number or repetitions can be increased and/or timed intervals can be used to achieve desired results. Speed of movement can be increased when using lighter loads. For example, a user can do the running exercise for 20 seconds, rest for 10 seconds, and repeat for a total of five sets.

To do reverse leg extensions, the user can place one foot in the foot or toe clip or harness, but keep the other foot on the ground. With shoulders against the shoulder harness, the user can bend the leg that is on the ground and extend the working leg until full extension is achieved. The working lever 108 or 110 can be made to come to a complete rest against the rubber pad on the support frame. This can emphasize quadriceps training. To emphasize gluteus and hamstring, the working leg can be pulled back against the resistance of elements 122 and 124.

The component that move during the exercise are selected to be strong but light in weight so that they would exhibit minimal momentum and inertia forces. As a result, the rate of flow through the respective valves can be the major, or nearly only, source of resistance to motion. Because inertia of elements of this exercise machine can play such a minimal role, the user can move as rapidly and explosively, or as slowly as desired. Because the resistance of elements 122 and 124 is controlled in each of two directions (up and down movement of the pistons therein), the user can exercise the muscle groups involved in both extending and bending the legs. Because the resistance that elements 122 and 124 offer in each direction can be set at different levels independently, the exercise machine can load different muscle groups differently in terms of resistance to motion and resistance to acceleration. Because the flow rate for each valve can be controlled independently, different resistance to motion and acceleration can be offered to left and right legs. And, if desired, the resistance can be controlled to change within a stroke down or up, so that a leg acts against different levels of resistance and acceleration depending on where the leg is in a push or pull stroke. As an alternative, the motion of the shoulder harness and/or its chest support relative to the frame can be motorized and computer-controlled so that the body angle can be changed during an exercise.

Figure 2:
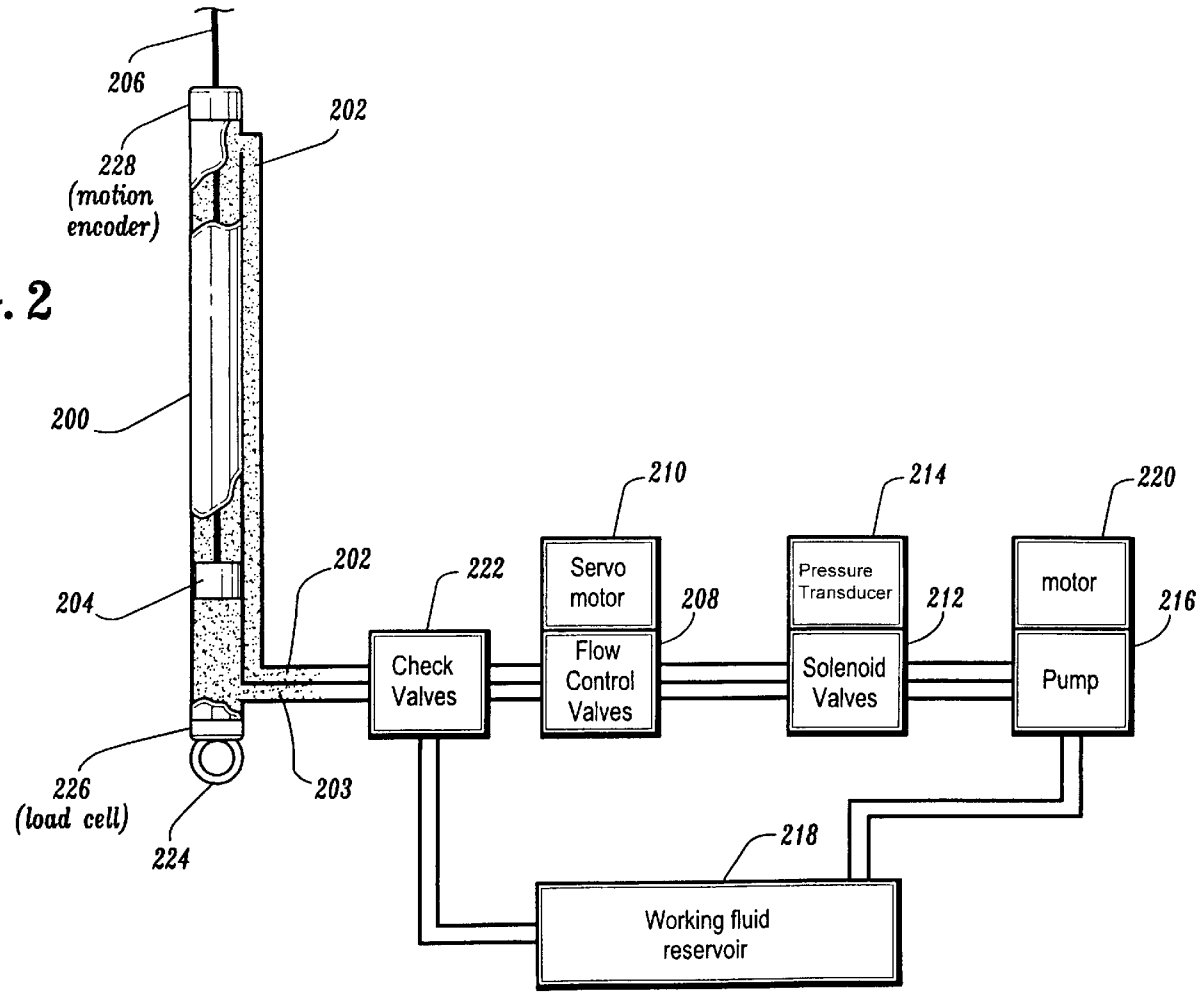
FIG. 2 illustrates a bi-directional resistance arrangement that can be used in the system of FIG. 1.

FIG. 2 illustrates a variable bi-directional resistance element and associated controls suitable for use as elements 122 and 124 in FIG. 1. A sealed cylinder 200 is filled with a fluid such as water or oil and has inlet/outlets at its top and bottom ends communicating with respective fluid conduits 202 and 203. A piston 203 rides up or down in cylinder 200, and is sealed against the cylinder's inner wall with one or more O-rings or otherwise to prevent or limit flow of working fluid from one side of piston 204 to the other. A shaft 206 is secured to piston 204 to move up and down therewith, and passes through the upper end of cylinder 200 in a manner that prevents escape of working fluid. A servo control valve comprises a valve assembly 208 and a servo motor 210, and individually controls the flow of working fluid in each direction of each of conduits 202 and 203. Solenoid valves 212 can be provided, in fluid flow communication with conduits 202 and 203, to release fluid pressure in the conduits when required. One solenoid valve can be normally on and another normally off, connected such that pressure can be released automatically in case of power failure or some other malfunction. A pressure transducer assembly 214 can use the same connection to conduits 202 and 203 as solenoid valves 212, or can use a separate connection, to monitor the fluid pressure in one or both of conduits 202 and 203. A pump 216 is interposed between a working fluid reservoir 218 and conduits 202 and 203. A motor 220 drives pump 216 to control the pressure of the working fluid delivered to conduits 202 and 203. One or more check valves 222 can be provided to connect conduits 202 and 203 to reservoir 218 for the purpose or relieving excessive build up of fluid pressure. The cylinder structure includes a pivot mount 224 at its lower end, for pivotal connection with a support frame by means of a pin passing through the opening in the mount. A load cell 226 is interposed between mount 224 and cylinder 200 to serve as a transducer supplying information regarding the forces acting on cylinder 200. A motion encoder is secured at the upper end of cylinder 200 to track the motion and position of shaft 206 and piston 204 relative to cylinder 200.

As piston 204 moves up or down in cylinder 200, it forces working fluid out of the cylinder at one and, through the fluid conduits and other components, back into the other end. Depending on the size of the valves and their instantaneous openings, the rate of fluid flow through one or more valves is felt by the user as resistance to leg motion. With open valves, shafts 126 and 128 move freely and the user feels little resistance to motion and little inertia. As the relevant valve or valves move toward a closed position, they restrict the rate of fluid flow more and more and the user feels more and more resistance and needs more force to extend or bend a leg. When the valves close fully, the system is locked in place. The system thus allows control over resistance to motion in each direction, independently for each leg, and also during a stroke.

Figure 3:
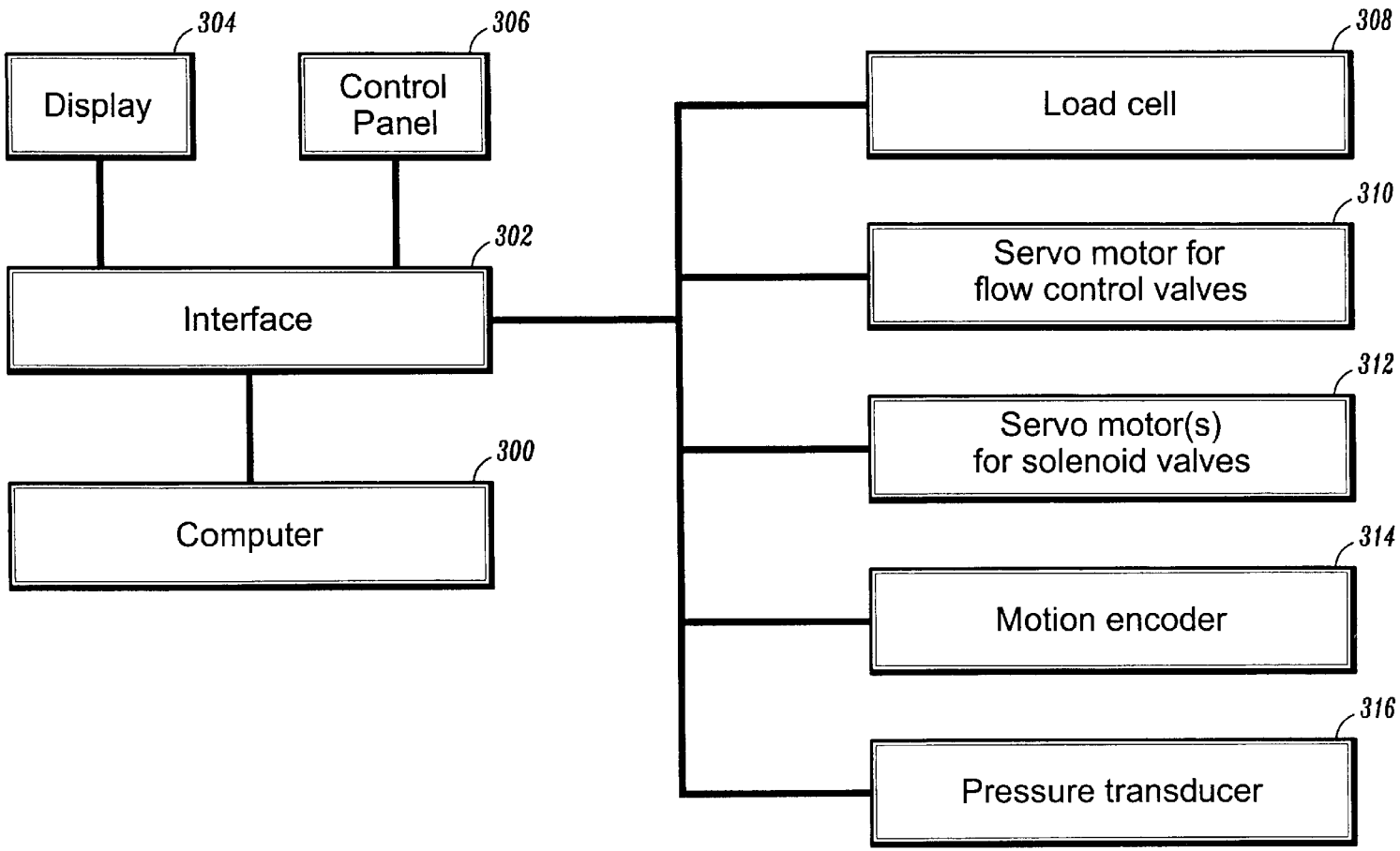
FIG. 3 illustrates a computer control for the arrangement of FIG. 2.

FIG. 3 illustrates schematically an arrangement for controlling the system of FIG. 1 when it uses the arrangement of FIG. 2 for each of the resistance elements 122 and 124. A computer 300 can be the same or similar to computer 132 in FIG. 1 and is programmed to carry out the required operations. It communicates through an interface 302 with a display 304 and a control panel 306 that can be the same as or similar to elements 134 and 136 in FIG. 1, and with a number of the elements of FIG. 2. Specifically, computer 300 communicates through interface 302 with a load cell 308 that can be the same as or similar to cell 226 in FIG. 2, a servo motor 310 that drives flow rate control valves and can be the same as or similar to motor 210 in FIG. 2, one or more servomotors 312 that can be the same as or similar to servomotor(s) that control solenoid assemblies 212 in FIG. 2, a motion encoder 314 that can be the same as or similar to encoder 228 in FIG. 2, and a pressure transducer 316 that can be the same as of similar to transducer 214 in FIG. 2.

In operation, computer 300 stores exercise programs that comprise instructions on analyzing inputs from an internal clock and from transducers such as load cell 308, motion encoders 314 and pressure transducers 316 in order to generate and send commands to controlled elements such as motors 310 and 312. Further, computer 300 can receive inputs from a user or trainer through control panel 306 to modify various aspects of the stored exercise programs, such as time duration, resistance to movement and the like, or to create and store new exercise programs. For example, an exercise program can include commands from computer 300 to servomotor 310 to open flow control valves 208 to positions causing the cylinder structure to resist movement of the foot pedals with a specified force. Computer 300 interrogates load cell 308 and/or pressure transducer 316 frequently, e.g., 1024 times per second and, depending on force and/or pressure readings therefrom, controls servo motor 310 to open valves 208 more or less to maintain the required pressure on piston 204 and, thus, the required resistance to motion by the user. If the exercise program requires one force level for one leg and a different force level for the other leg, computer 300 issues appropriate commands to the respective servo motors 310 for the left and right legs to maintain different pressures on the pistons for the left and right cylinder arrangements, and maintains the required pressures using the feedback loop comprising load cell 226 and/or pressure transducer 316 and servo motor 310. If the exercise program requires one force for pushing back with a leg and another for pulling, this is accomplished in a comparable manner, through maintaining one pressure on the respective piston 204 for the down stroke and another for the up stroke. If the exercise program calls for changing the pressure during a stroke, this is accomplished by changing the flow rates to cause the desired changes in pressure on the piston, using the same feedback arrangement. The feedback loop can also use inputs from motion encoders such as 314, preferably one for each leg. The motion encoders can supply computer 300 with frequent readings, such as for each mm of movement of shaft 206 relative to cylinder 200, and computer 300 can use this input to determine at what level to set the pressure on piston 204 at each point of the movement of the user's leg, individually for each leg and for each direction of movement. Similarly, computer 300 can use inputs from the motion encoders to limit the extent of movement, for example by commanding the position of the flow valves to increase the pressure in the appropriate direction to such a high level that the user can no longer move the appropriate leg in the selected direction.

The choice of components for the system depends on many factors. One choice can be: a two-way, single ended cylinder for the arrangement of FIG. 2; a rotary, spool type valve for controlling the flow of fluid from one end of the cylinder to the other; an electric, DC stepping motor that adjusts the servo valves opening as commanded by control signals from the computer; shielded, explosion-proof conduits for the flow of fluid through the respective components; and a motion encoder that can be a linear or an angular optical encoder, or a resolver, or some other encoder, preferably in each case with appropriate hardware/software to translate raw encoder outputs to the format the computer requires.

Computer 300 can use the information collected from transduces such as the motion encoder(s) and the load cell as well as time information from its own clock, to generate, store and display data on the performance of a user. For example, such performance data can be displayed to the user at display 314 while the user is exercising, it can be collected and stored over a period of time, and it can be analyzed by user, by groups of users or in other ways to help plan or for other purposes.

Using control panel 306 and display 304 a user can select from a variety of exercises and may vary the programmed velocity of resistance pattern for both push and pull segments of the exercise and establish the number and sets or session variations that will set the desired goal. For example, the goal can be expressed as time, total work exerted, work load, user exhaustion limit based on a percentage of the user's best performance, other factors, and combinations of factors.

As an example, assume that a user has selected an exercise that requires pushing with the right leg that should start the downstroke at 200 pounds and decrease linearly to 100 pounds, and pulling at a steady 120 pounds on the upstroke, and has selected a stroke that starts and stops at specified positions, and has selected one set of ten repetitions. The computer moves the right foot pedal to the required starting position, the user moves it to that position and the computer senses that though inputs from motion encoder 314. With the foot pedal at the starting position, the computer commands the appropriate valve to close until load cell 308 senses 200 pound of force in the up direction (downstroke of the foot pedal and extension of leg). The downstroke starts and, because the force should decrease linearly, assume that an intermediate position that is sensed by motion encoder 314 the force should be 196 pounds. If the user is still pushing with 200 pounds of force, the computer commands the appropriate valve to open more until the resistance the cylinder offers is 196 pounds. If the measured force that the user exerts at that intermediate point had been 194 pounds, the computer would have closed the valve until a measure of 196 pounds is detected through load cell 308. As the user continues to extend the right leg, the computer responds appropriately to require a force at the correct level for each position in the stroke. When the user reaches the end position of the down stroke, the computer detects this through motion encoder 314 and closes the appropriate valve to prevent further down movement. The computer may signal this to the user through display 304 and/or through an audible signal. When the user starts the upstroke, the computer maintains the required 100 pound steady resistance in a similar manner. During the exercise, the computer can display at 304 parameters such as the current and desired number of repetitions, the forces involved, the movement velocity, etc. The data can be recorded in computer memory and/or archival storage for later user and analysis and/or can be analyzed during the exercise and displayed so the user can see graphically parameters such as differences between planned and actual performance and the like. In this example, little or no inertial resists movement, as the only parts of the machine that move are relatively light. The resistance to motion is therefore essentially independent of the speed of motion. Alternatively, or in addition, the user can select a velocity component so that resistance to movement is a function of velocity. This is programmed in the computer in a manner similar to programming resistance as a function of position, and resistance as a function of velocity can be implemented similarly. For example, the computer uses input from motion encoder 314 to determine current velocity, compares the measured velocity with the desired velocity, and controls the fluid flow valves to reduce any differences between the measured and the desired velocities. With the ability to control the force resisting movement as a function of both position in the stroke and actual velocity, more complex combinations of both modes can be designed to achieve desired training effects.

The embodiments described above are only illustrative examples, and it should be clear that many variations will occur to those skilled in the relevant technology and that such variations are meant to be encompassed by the appended patent claims.

What is claimed is:

1. An exercise system comprising:

a support structure;

a shoulder harness secured to the support;

at least one bi-directional resistance element;

a computer control coupled to the at least one bi-directional resistance element to control the resistance thereof in each of two directions;

a pair of foot pedals coupled to at least one bi-directional resistance element, each foot pedal moving against a resistance in each of two directions provided at least in part by said at least one resistance element;

said foot petals being at selectable distance from said shoulder harness to enable a user with shoulders against the shoulder harness and feet on the foot pedals to select one of a range of body angles relative to the support structure.

2. A system as in claim 1, in which said at least one bi-directional resistance element comprises two resistance elements, each coupled to a respective one of said foot pedals to provide resistance to movement thereof in each of two directions, the resistance of each of said elements being controlled by said computer control.

3. A system as in claim 2 in which said computer control independently controls the resistance of each of said elements in each of two directions.

4. A system as in claim 3 in which each of said elements comprises a fluid filled cylinder with a piston movable there along and at least one valve in fluid flow communication with said fluid and controlled by said computer control to allow flow of said fluid at a rate controlling resistance to the movement of said piston in each of two directions.

5. A system as in claim 4 in which each of said pistons is coupled to a respective one of said foot pedals to move along the respective cylinder in a respective direction in response to a user moving the respective piston in each of two directions.

6. A system as in claim 1 in which said shoulder harness is mounted on said support structure for sliding movement thereon up and down, and including a locking structure selectively locking the shoulder harness to said support structure at a selected relative position therebetween, thereby at least in part determining said selectable distance between the shoulder harness and the foot pedals.

7. A system as in claim 1 in which said at least one resistance element comprises two elongated resistance elements each providing selectable resistance in each of two direction, extending side-by-side up from a lower portions of said support structure, and said system further includes a pair of side-by-side direction-reversing levers each having one end coupled to a respective one of said foot pedals, an intermediate portion pivoted at an upper portion of said support structure, and another end coupled to an upper portion of a respective one of said elongated resistance elements.

8. A system as in claim 7 in which each of said elongated resistance elements has a piston movable therein against fluid in the cylinder and at least one valve controlling the flow of said fluid and thereby the force needed to both move and accelerate the cylinder, said valve being under control of said computer control.

9. A system as in claim 8 in which said upper portion of each of said elongated resistance elements comprises a shaft coupled to the piston to move therewith relative to the cylinder.

10. An exercise system comprising:

left and right bi-directional resistance elements;

left and right foot pedals operatively connected to said left and right resistance elements, respectively;

each of said foot pedals being mounted for motion through a range of position in each of two directions, against resistance to motion and acceleration in each of said two directions by the resistance element coupled thereto;

a computer control operatively coupled to each of the resistance element to control the resistance thereof to said motion and acceleration of the respective one of said foot pedals in each of said two directions;

a shoulder harness; and a frame maintaining the shoulder harness and the foot pedals at a selected one of a range of positions relative to the foot pedals.

* * * * *